United States Patent [19]

Krolopp et al.

[11] 4,202,759

[45] May 13, 1980

[54] CENTRIFUGAL SCREENING APPARATUS

[75] Inventors: Otto C. Krolopp, Downers Grove; Leonard M. Haluch, Chicago, both of Ill.

[73] Assignee: Prater Industries, Inc., Chicago, Ill.

[21] Appl. No.: 963,402

[22] Filed: Nov. 24, 1978

[51] Int. Cl.[2] ..... B07B 9/00

[52] U.S. Cl. ..... 209/234; 209/270; 209/273; 209/284; 209/291; 209/300; 209/473; 209/482

[58] Field of Search ..... 209/289-291, 209/234, 284, 289, 300, 372-373, 270, 273, 482, 473; 210/415; 29/116 R

[56] References Cited

U.S. PATENT DOCUMENTS

| | | | |
|---|---|---|---|
| 284,405 | 8/1883 | Forder et al. | 209/291 |
| 632,637 | 8/1899 | Brooker | 209/291 |
| 1,223,607 | 4/1917 | Pantale | 209/291 |
| 1,387,238 | 7/1921 | Iaue | 209/270 |
| 1,418,545 | 6/1922 | Earle | 209/291 |
| 2,398,955 | 3/1945 | O'Toole | 209/291 |
| 2,601,924 | 7/1952 | Gonder | 209/284 |

OTHER PUBLICATIONS

Bulletin No. CS-70, Kason Corp., "Centri-Sifter", 231 Johnson Ave., Newark, N.J. 07108.

Bulletin No. RS-75, Prater Ind., "Rota-Sieve", 1515 S. 55th Ct., Chicago, Ill. 60650.

*Primary Examiner*—Frank Sever

*Attorney, Agent, or Firm*—McWilliams, Mann & Zummer

[57] ABSTRACT

A centrifugal screening apparatus for scalping or sizing bulk materials in which an auger assembly conveys the bulk materials from an intake chamber into a cylindrical screening sleeve mounted within an enclosed screening chamber and subjects the bulk materials to centrifugal force for impingment against the screening sleeve, with the fines passing through the screen for gravity discharge from the screening chamber and the tailings being conveyed to a separate tailings chamber for separate gravity discharge therefrom. The auger assembly within the screening sleeve is equipped with a cylindrical shell integral with the auger assembly and extending the effective length of the screening sleeve that defines along the length of same uniformly spaced apertures thereabout that are separated by imperforate walling. The shell apertures are proportioned to restrict bulk materials movement therefrom under the centrifugal forces involved so that the bulk material feeding action of the auger assembly longitudinally of the screening sleeve acts to distribute the bulk material lengthwise of the shell for uniform screening application of the bulk materials to the screening sleeve. Tramp metal and other foreign materials are retained within the shell for removal when the apparatus is not operating, thereby protecting the screening sleeve against rupture during operation.

8 Claims, 9 Drawing Figures

CENTRIFUGAL SCREENING APPARATUS

This invention relates to centrifugal screening apparatus, and more particularly to apparatus for screening bulk materials of the general type in which an auger assembly feeds the bulk materials into a cylindrical sieve mounted in an enclosed screening chamber. Within the sieve movement inducing paddles of helical contour that rotate with the auger induce rotational movement of the bulk material providing for a centrifugal force induced impingment of the bulk materials against the screen, with the fines passing through the screen and the tailings remaining within the screen. The fines are caught within the screening chamber and drop by gravity through the screening chamber outlet, while the tailings are conveyed into a separate tailing chamber for separate discharge therefrom.

A commercial example of this type of equipment is the ROTA-SIEVE screening machine made and sold by Prater Industries Inc. of Chicago, Illinois, though similar equipment is offered by a number of companies in the U.S.A. and abroad. Machines of this type are also generally known as centrifugal sifters, scalpers and sizers, and may be employed to screen, scalp, or size a wide variety of bulk materials in powdered, granular, or agglomerated form, such as chemicals, pharmaceuticals, food products, animal feed, and plastics.

The auger assembly of this type of equipment operates at relatively high speeds, such as 700 rpm for standard sized units. While the screens employed in this type of equipment are designed to readily withstand the impingment thereagainst of the bulk materials being treated, the basic problem with this type of equipment is that foreign materials of relatively high density, such as tramp metal in the form of nuts, bolts, tools, and parts of tools in machines that may have been involved in the earlier processing of the bulk material involved, and other foreign materials such as stones, when thrown outwardly by the operation of the auger assembly, pass right through and thus rupture the screening employed, thus leaving unwelcome large holes in the screen and impairing if not rendering inoperative the screening function of the machine. As the screens involved in equipment of this type have to be enclosed in housings to not only catch the fines that pass through the screening, but also preferably to operate in a dust free manner, and machines of this type cannot readily be equipped to detect the presence of tramp metal and the like passing into same with the bulk materials being processed, it heretofore has been necessary to periodically check the machine to be sure that the machine screenings have not become punctured for this reason.

While it may be possible to design into such machines detection and control equipment that will shut the machine down when the presence of tramp metal or the like in the bulk materials entering the machine is detected, there still remains the problem of physically locating and removing the foreign material involved, together with the loss and inconvenience due to the down time of the machine. Similarly, detection and signaling systems can be devised to alert the operator when the machine screen has been broken by tramp metal or the like, but this adds to the complexity and thus the cost of the machine and there still remains the problem of shutting down the machine to replace the screen.

Another problem experienced with machines of this general type is that the bulk material at the in-feed end of the screen tends to build up against the screen causing undue wear on the screen. This problem has been alleviated to some extent by employing a rotating kicking device that is suppose to throw the built up bulk materials at the in-feed end of screen further into the screen. While this reduces bulk material concentration in the screen wear somewhat, at the screen in-feed end, the screening application of the bulk material on the length of the screen remains unduly concentrated on the first half of the screen lengths.

A principal object of this invention is to provide a centrifugal screen apparatus of the type indicated and a method of centrifugal screening, in which the bulk material is not only well distributed along the screen for screening purposes, but also the damage causing foreign materials, such as the indicated tramp metal and stones, is caught and retained within but spaced from the screening sleeve in spite of the high centrifugal forces acting on same, for removal at a convenient time when the machine is shut down.

Another principal object of the invention is to provide the auger assembly of centrifugal screening machines or scalpers with a combination bulk material distributor and foreign material trap that serves to better distribute the bulk material along the screen length, for screening purposes, while using the centrifugal force involved to hold tramp metal and the like against movement relative to the trap and within but free from contact with the screening sleeve itself, as long as the machine needs to operate, before a routine inspection of the screening sleeve is normally required, and when the machine operation is discontinued, the foreign material remains held within but free from contact with the screening sleeve, until removal of same can be effected by way of routine maintenance practices.

Another important object of the invention is to provide a centrifugal screening apparatus that is economical of manufacture, applicable to a wide variety of materials for screening, scalping, and sizing purposes, and that is thus free and long lived in operation.

In accordance with the invention, the centrifugal screening apparatus is provided comprising a housing defining a tubular bulk materials in-feed chamber, a screening chamber in open side by side communication with the in-feed chamber, and a separate tailings chamber in open side by side communication with the screening chamber. Journaled for rotation in the in-feed and screening chambers is an auger assembly, which, in the screening chamber, is disposed in concentric relation with a screening sleeve that is removably mounted. The housing is arranged to make the screening chamber closed to the tailings chamber exteriorily of the screening sleeve, and to provide for separate gravity discharge of the materials passing into the screening chamber through the screen, and the tailings that do not pass through the screen but are conveyed into the tailings chamber.

The auger assembly within the cylindrical screen is equipped with a combination foreign material trap and bulk material feed distributor comprising a cylindrical shell that extends the effective length of the screening sleeve and is proportioned to have its outer surfacing in closely spaced relation to but spaced from the screening sleeve. The cylindrical shell is formed to define lengthwise thereof uniformly spaced apertures thereabout that are separated by imperforate walling, and that are sized to pass the fines and tailings while exercising restriction on the flow of material passing through the sleeve apertures for achieving uniform application of the bulk materials to the screen along the length of same.

The auger assembly and cooperating parts of the housing are shaped and proportioned to accommodate passage of the tramp metal and the like that enter the machine with the bulk materials being processed without jamming. The tramp metal and other foreign materials are retained within the bulk material distributing shell, with metal and other objects of relatively high density adhering to the inside of the shell under the centrifugal forces that are involved, whereby the screening sleeve is protected from damage.

When the machine is shut down, the foreign material remains contained within the material distributing shell for removal as part of routine maintenance practices.

Other objects, uses, and advantages will be obvious or become apparent from a consideration of the following detailed description and the application drawings.

Figure 1:
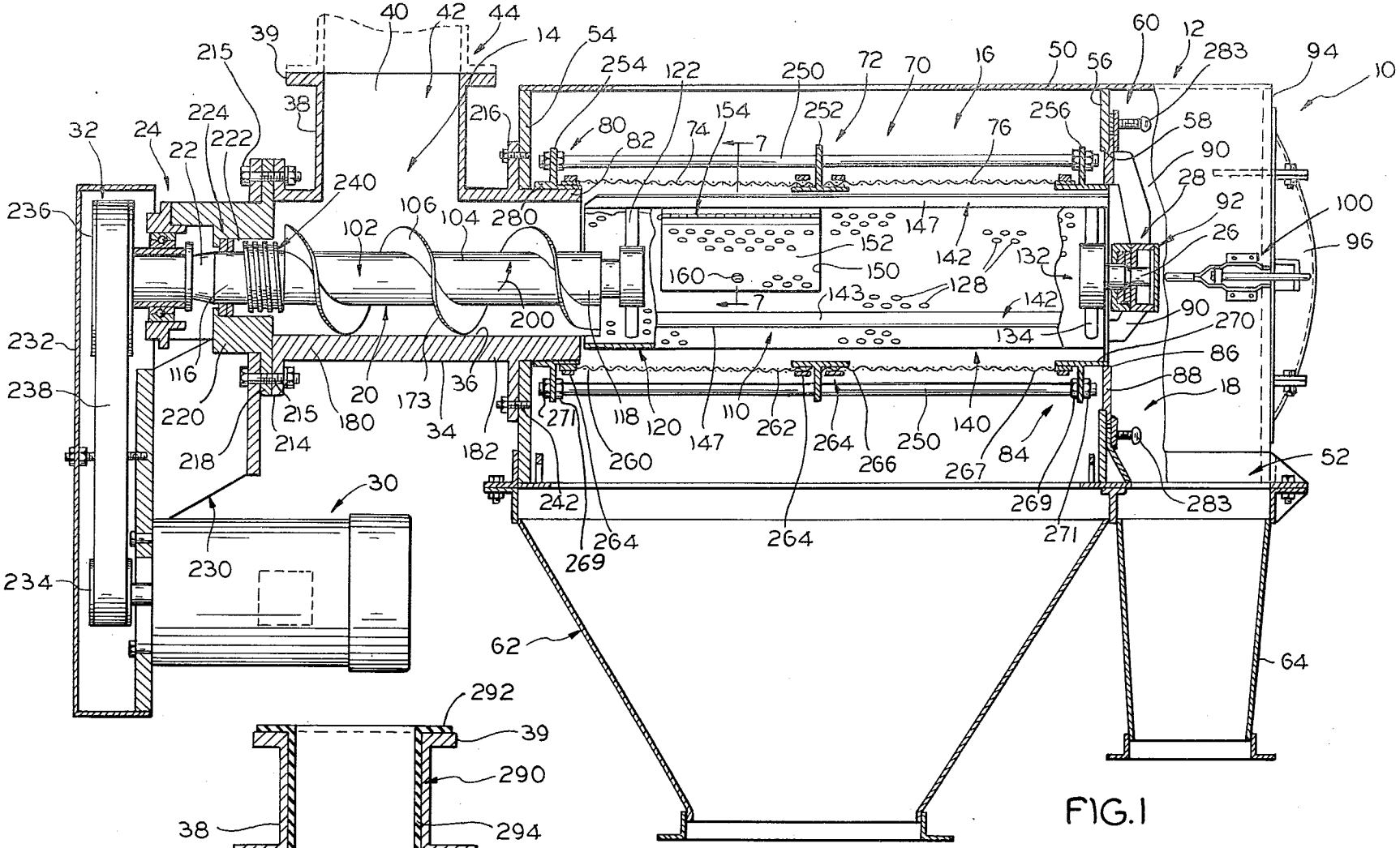
FIG. 1 is a diagrammatic side elevational view of one embodiment of the invention, with parts broken away and shown in section to expose other parts for illustrative purposes.
Figure 2:
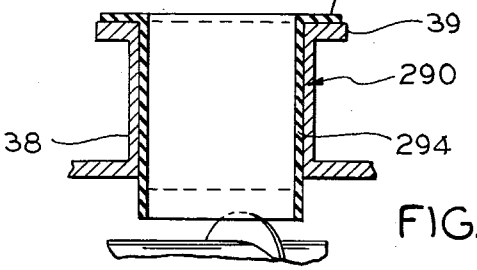
FIG. 2 is a fragmental sectional view showing a supplemental feature of the invention.
Figure 3A:
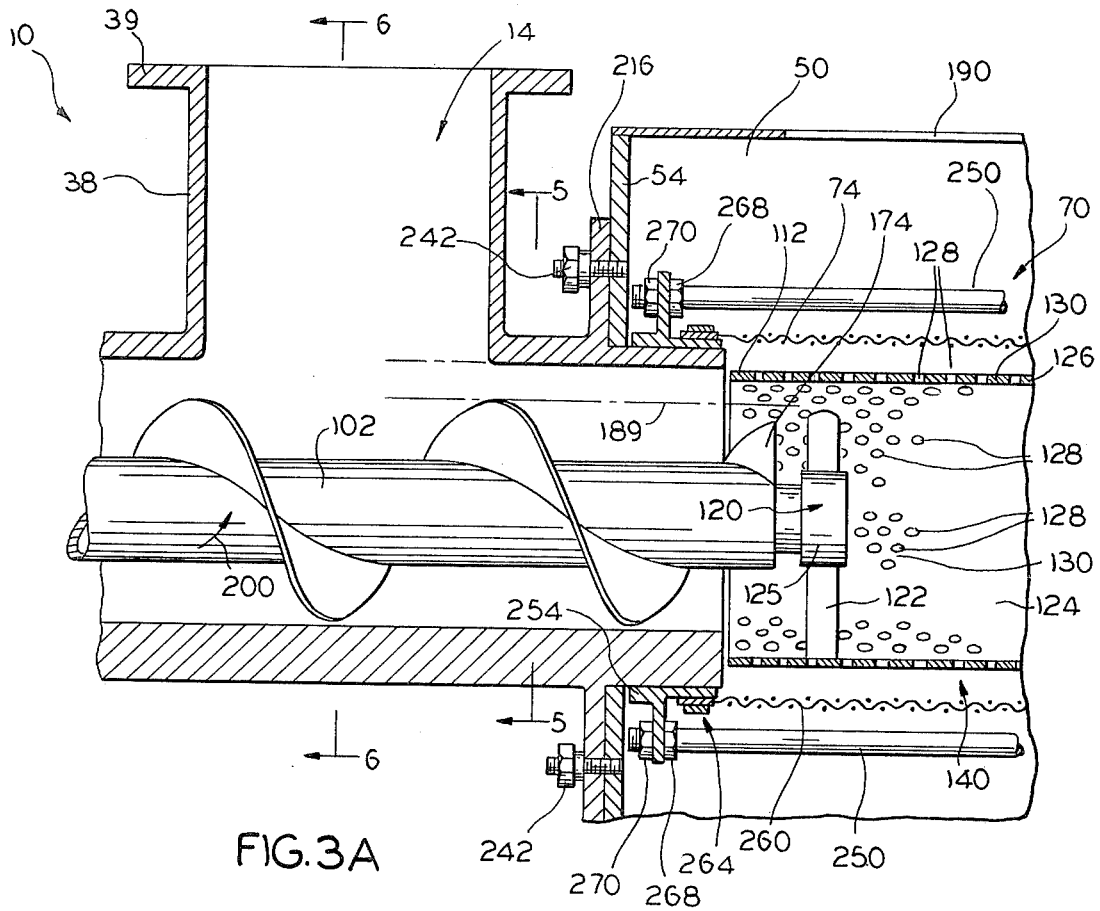
Figure 3B:
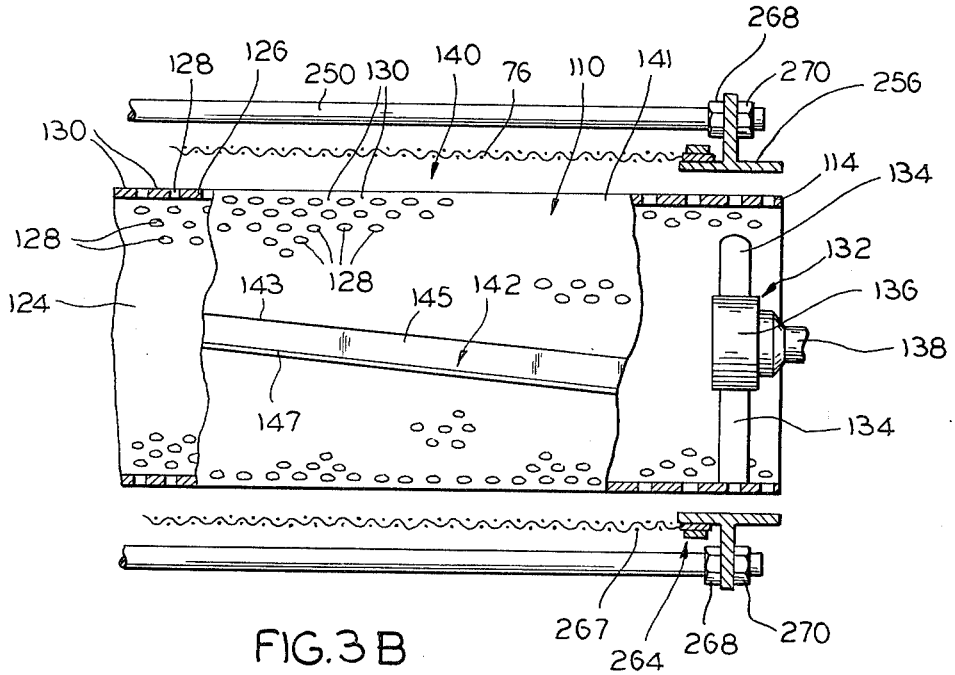
Figure 4:
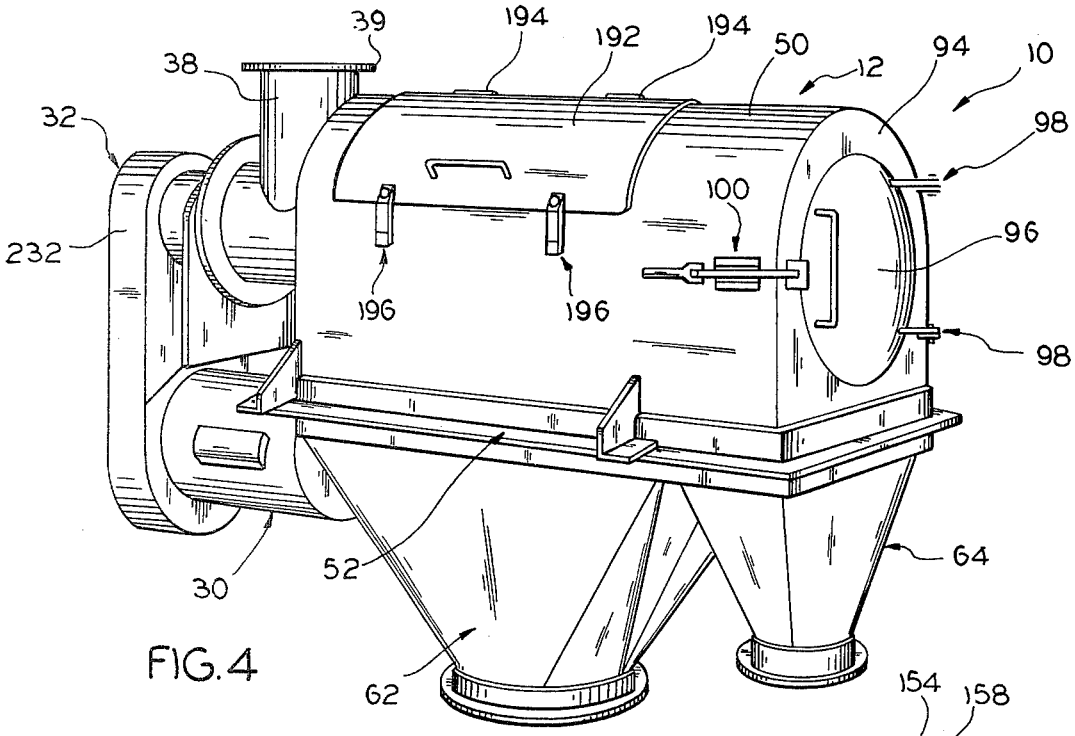
Figure 6:
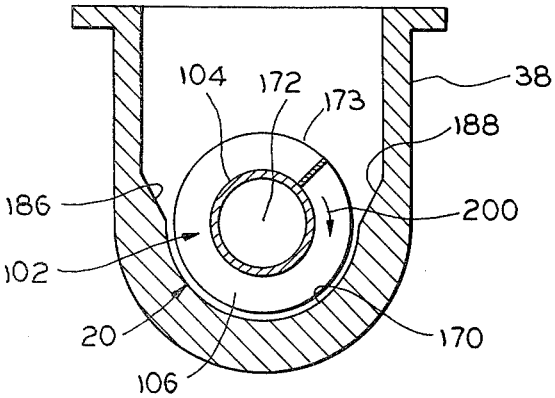
Figure 7:
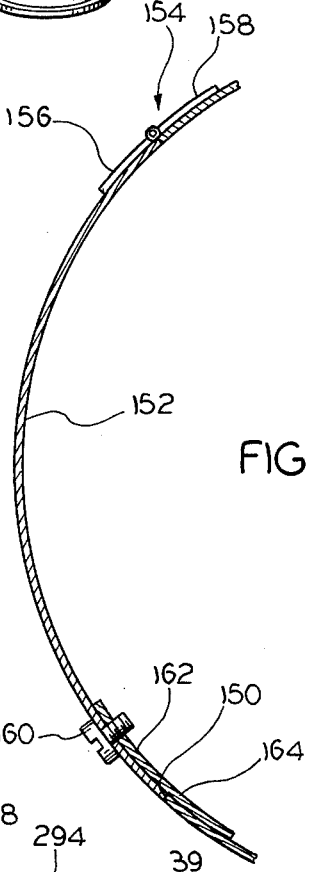
Figure 5:
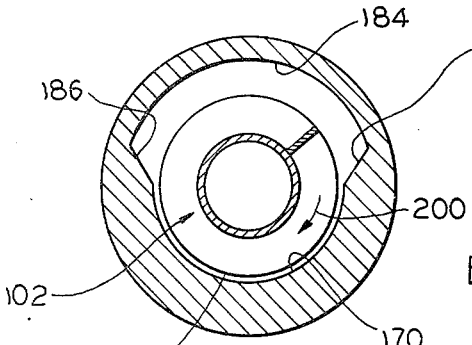
Figure 8:
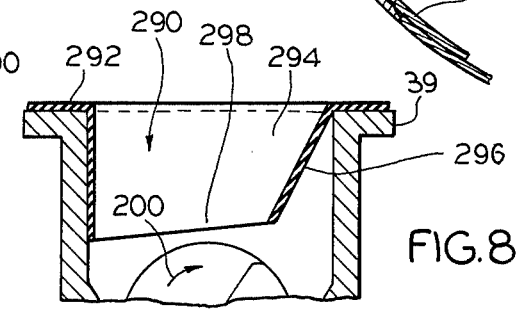

FIGS. 3A and 3B considered together show on an enlarged scale the auger assembly and associated parts that deal with the basic aspects of the present invention;

FIG. 4 is a diagrammatic perspective view illustrating the embodiment of FIG. 1, 3A and 3B;

FIG. 5 is a diagrammatic sectional view substantially along line 5—5 of FIG. 2A;

FIG. 6 is a diagrammatic fragmental sectional view taken substantially along line 6—6 of FIG. 2A;

FIG. 7 is a diagrammatic fragmental sectional view taken substantially along line 7—7 of FIG. 1; and FIG. 8 is a view similar to that of FIG. 6 but illustrating the supplemental features shown in FIG. 2.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

GENERAL DESCRIPTION

Reference numeral 10 of FIGS. 1 and 4 generally indicates a preferred embodiment of the invention comprising housing 12 defining a supply or in-feed chamber 14, a screening chamber 16, and a tailings chamber 18 that are in consecutive alignment longitudinally of the machine 10. Rotatably mounted in the machine 10 is an auger assembly 20 that is journaled at its end 22 where indicated at 24, and at its opposite end 26 where indicated at 28. The auger assembly 20 is rotated at a speed lying in the range of about 200 rpm to about 1,200 rpm depending on the size of the machine. For the specific machine illustrated, a standard intermediate size is contemplated which will have a speed of rotation that approximates 700 rpm (710 rpm in such models built for commercial use). The auger assembly 20 is driven suitable drive motor 30 through suitable drive belt assembly 32 (see FIG. 1).

The in-feed chamber 14 is defined by a tubular housing member 34 formed to define the in-feed bore 36 in which the auger assembly is disposed and an upstanding sleeve portion 38, the bore 40 of which defines the inlet 42 to the in-feed chamber 14. The sleeve portion 38 is suitably connected to a supply hopper or the like generally indicated by reference numeral 44, from which the bulk material is supplied under gravity to the machine 10 for screening purposes. For connection purposes, sleeve portion 38 is flanged as at 39.

The housing 12 in the form shown is of fabricated sheet metal construction comprising in addition to the tubular member 34 a U-shaped housing sheet 50 disposed in inverted U form to form the top and side walls of the housing 12 in association with a suitable framing 52 along the lower edges of the sheeting 50. The sheeting 50 is suitably fixed to end wall 54 that forms one end of the screening chamber 16 and an inner divider plate 56 that forms the other end of the screening chamber, the latter being formed with a relatively large aperture as at 58 for purposes of receiving the end 26 of the auger assembly and a mounting plate assembly 60 for journaling same within the tailings chamber 18. The housing 12 includes a suitable funnel structure 62 through which the fines are discharged from the screening chamber 16, while the tailings chamber 18 is provided with a suitable funneling structure 64 through which the tailings are discharged from the tailings chamber 18. The funneling structures 62 and 64 are suitably secured to the framing 52.

Operably disposed within the screening chamber 16 is a conventional screening sleeve or cylinder 70 in the form of a multi screen assembly 72 that is per se conventional, and comprises a pair of sleeve type screening elements 74 and 76 assembled in aligned coaxial relation and formed from a suitable foraminous material of synthetic fiber or metal mesh type construction of which the mesh may be selected to be coarse, medium or fine depending on the nature of the bulk materials to be screened or scalped. The screening sleeve 70 in the form illustrated is removably mounted and has its end 80 received on the discharge end 82 of the tubular housing member 34 and its other end 84 received within the bore 86 of annular mounting plate 88 forming a part of the removable mounting plate assembly 60 that is removably mounted within the tailings chamber 18 and in the form shown includes spider type mounting arms 90 which serve to mount the bearing 92 in which the end 26 of the auger assembly is journaled.

The housing 12 in the area of the tailings chamber 18 includes end wall 94 that is apertured to define an access opening to chamber 18 which is closed by suitable access door 96 hinged to the housing 12 as at 98 and held in closed position by suitable latch device 100.

The auger assembly 20, in accordance with the invention, comprises auger 102 comprising suitable shank 104 and spiraled flighting 106 suitably affixed thereto in coaxial relation thereabout for feeding of the bulk materials from the in-feed chamber 14 into the screening sleeve 70 when rotated by motor 30 and drive assembly 32. Within the screening sleeve 70 the auger assembly 20 comprises a cylindrical shell 110 formed from stainless steel or the like that is fully opened at its ends 112 and 114 and is oriented to be coaxially arranged with the auger 102.

The auger 102 at its end 116 forms the end 22 of the auger assembly 20, and at its end 118 it has suitable spider structure 120 fixed thereto that includes, in the form shown, three spider arms 122 in equally spaced relation thereabout that are suitably fixed to the inside surface 124 of the shell 110 and collar 125 that is fixed to auger 102.

The shell 110 itself is defined by cylindrical encompassing side wall 126 that is formed along the length of the shell with a plurality of uniformly spaced apertures 128 that are separated by imperforate walling 130 forming the side wall 126.

The shell at its end 114 has fixed thereto a suitable spider assembly 132 including spider arms 134 that in the form shown are three in number in equally spaced relation thereabout that are suitably connected between the inner surfacing 124 of the shell 110 and the spider collar 136 that is suitably affixed to stub shaft 138 which is journaled in suitable bearing structure 92.

The shell 110 between its ends 112 and 114 is fully opened for its length except for the spider assemblies 120 and 122, the spider arms of which are spaced apart to provide for ready bulk material movement about and through the respective spider assemblies 120 and 132.

As indicated, the shell 110 is disposed in concentric relation with the screening sleeve 70 and coaxially of the auger 102 whereby an annular screening space 140 is defined by the shell 110 and the screening sleeve 70. Affixed to the external surfacing 141 of the shell 110 are a plurality of wiper bars or blades 142 that extend generally longitudinally of the shell 110 but are disposed in a relatively flat helical contour about the shell surfacing 142 to induce movement of the tailings in the screening space 140 in the direction of the tailing chamber that the screening space 140 is open to at the end 114 of the shell 110 (see FIG. 3B). Blades 142 are three in number and are equally spaced apart about shell 110, in the illustrated embodiment, and in the form shown comprise angle members 143 having their flanges 145 affixed to shell 110 and their flanges 147 in upstanding relation thereto.

The cylindrical shell 110 is thus an integral part of and rotates with auger assembly 20. In accordance with the present invention, the shell 110 serves as a bulk material distributor device that in combination with the feeding action on the bulk materials that is provided by the auger 102, provides for improved uniform distribution of the bulk materials and its application along the length of the screening sleeve 70. In addition, the shell 110 serves as a foreign material trap that retains in same foreign objects such as the aforementioned tramp metal that heretofore has been thrown through the screening sleeve under the centrifugal forces acting on same that are induced by the rotation of the auger assembly 20 in the operation of the machine 10.

For accomplishing these purposes, the sizing of the apertures 128 is selected to so restrict the movement of the bulk materials radially through the shell 110 that the feeding action induced on the bulk materials longitudinally of the shell by the action of the auger 102 pushes the bulk materials in the area of the axis of rotation of the shell adjacent its end 112 through the bulk materials that have lined the inner surfacing 124 of the shell 110 so that as the machine operates, the bulk materials will be sufficiently fed lengthwise of the shell 110 under the induced feeding action involved to achieve substantially uniform screening application of the bulk materials to the screening sleeve 70 lengthwise thereof when the bulk materials are thrown radially outwardly of shell 110.

For this purpose, the apertures 128 are typically on the order of ¼ of an inch in diameter, but the opening size in practice will depend on the nature of the bulk materials being screened or scalped. For bulk materials of the type indicated, the size of the openings for apertures 128 in terms of maximum dimension may lie in the range of from about ⅛th of an inch to about ¾ths of an inch, depending on the application and the particulate sizing of the bulk materials being processed.

In the form illustrated, the shell 110 is formed with an access opening 150 that is closed by a gate 152 that is shaped to substantially complement the size of the opening 150 and is connected for hinging movement with respect to the shell 110 by suitable hinge 154 having one leaf 156 thereof fixed to the gate 152 and the other leaf 158 affixed to shell 110, all in any suitable manner, as by welding. Gate 152 is secured in its closed position in the illustrated embodiment by fastener screw 160 threadedly applied to suitable fastener plate 164 that is suitably fixed to the shell 110, as suggested by FIG. 7.

Further in accordance with the invention, the in-feed chamber 14 is shaped specifically to accept tramp metal and the like without risk of jamming the auger. For this purpose, the in-feed chamber 14 has the configuration illustrated in FIGS. 5 and 6, whereby the lower surfacing 170 of the in-feed chamber 14 is of semi-cylindrical configuration on either side of the auger 102 up to the level of the axis 172 of rotation of the auger assembly 20. The surfacing 170 is struck on an arc that provides for close fitting relation with the outer rim 173 of the auger flighting 106, with a spacing of about one ⅛th to about ¾th of an inch between the external maximum diameter of the auger flighting and the surfacing 170 being preferred. The housing member 34 has its bore 36 defined so that within the two tubular end portions 180 and 182 of the housing portion 34, the auger flighting will be spaced substantially from the bore upper surfacing 184, as indicated in FIG. 5, to avoid wedging of foreign material, and in particular tramp metal of the type indicated, between the auger and housing member 34; a spacing of about one seventh of the external diameter dimension of flighting 106 is appropriate. On either side of the bore 36, the housing member 34 defines upwardly diverging wall surfacings 186 and 188 which serve as guides to center foreign material objects within the convolutions of the flighting 106 in operation of the machine 10.

In addition, the flighting 106 at its discharge end 174 is received within the intake end 112 of the shell 110 and is tapered radially in the direction of feed to be of reduced radial dimension relative to the auger, as indicated by the broken level line 189 of FIG. 3A.

In a specific embodiment of the invention, the auger has a maximum diameter defined by the flighting rim 173 of 4½ inches, and the flighting at the auger end 174, and specifically that within the shell 110, is reduced radially of the auger approximately ½ inch in diameter in a smoothly curved manner. This is for the purpose of increasing the clearence between the auger end 174 and the shell end 112 to insure that foreign objects, and in particular bolts, tools and parts of same, do not become wedged between the auger and the end 112 of shell 110.

The housing sheeting 50 is formed across the top of same with an access opening 190 (see FIG. 1) that is closed by suitable gate 192 suitably hinged to the housing 12 as at 194, which may be locked in sealed closed relation with the housing 12 by a suitable latch devices 196. The access opening 190 is positioned for access to the shell access opening 150 when the conventional screening sleeve 70 is removed through the housing end access opening (as elucidated hereinafter) that is closed by gate 96, for purposes of removing foreign materials from the shell 110 when the machine 10 is shut down.

In operation, the auger assembly 20 is put into rotation and the bulk materials to be screened are supplied to the intake sleeve 38 by gravity feed from a suitable hopper or the like through conduit 44. The rotational action of the auger assembly 20 in the direction indicated by the rotational arrows 200 rotates both the auger 102 and the shell 110 as a unit with the result that the auger flighting 106 feeds the bulk materials at a rapid rate from in-feed chamber 14 into the shell 110 through its open end 112. The rotational action imparted to the bulk materials within the shell 110 subjects the particulate matter involved to centrifugal forces which urge the particles involved outwardly and against the inner wall surfacing 124 of the shell. The proportioning of the apertures 128 is such that the bulk materials do not readily pass through same in a large flow rate relation, but rather the bulk materials tend to build up about and along the inner surfacing 124 of the shell 110, with the feeding action of the auger acting on the centrally disposed bulk materials forcing same longitudinally of the shell in the direction of its discharge end 114. As the bulk materials are thus being supplied in substantial quantity toward the end 114 of shell 110, the result is that the bulk materials when escaping under centrifugal force from shell 110 will be passing through apertures 128 substantially along the length of the shell 110, and thus in a distributed relation longitudinally of the screening sleeve 70. The bulk materials in so doing impinge against the screens 74 and 76 and are screened thereby, with the fines passing through the screening involved, and the tailings being conveyed lengthwise of the screening space 140 by the feeding action that is provided by the wiper bars 142. The wiper bars 142 also assist in the screening operation by functioning to wipe the bulk materials against the screens 74 and 76 that effect the screening function.

The fines pass into the screening chamber 16 for discharge from the funneling structure 62, while the tailings passing from the screening space 140 move into the tailings chamber 18 for discharge through funneling structure 64.

As the screening apparatus 10 operates, foreign materials, and specifically tramp metal such as nuts, bolts, tools, parts of tools, stones, and other items of materials of a density compared to steel and the like or greater, that are entrained in the bulk materials pass freely into and through the in-feed chamber 14 and into the interior of the shell 110 under the feeding action of auger 102. Within the shell 110 such items are moved radially by centrifugal force against the internal surfacing 124 of the shell and remain in place thereagainst as long as the machine 10 is operating.

Of course, the tendency of tramp metal to in effect become anchored against the inside surfacing 124 of the shell 110 while the machine operates also serves to restrict the bulk material flow through the shell apertures 128 and thus accommodate additional feeding of the bulk materials toward the end 114 thereof under the feeding action induced by the auger 102.

Of course, the shell 110 retains from radial movement therefrom all foreign materials as well as bulk materials that are too large in dimension to pass through the apertures 128. The bulk material tailings involved, of course, feed through the open end 114 of the shell and may be accompanied by the lighter mass items of foreign materials such as such as pieces of wood or other vegetable matter, paper and other items of trash that may become entrained in the bulk materials and which do not have sufficiently heavy densities to remain adhered to the inner surfacing 124 of the shell under centrifular forces induced by the rotation of the auger assembly 20.

When the machine 10 is shut down, the tramp metal, stones etc. are retained within the shell 110, and thus within the screening sleeve 70, but are held out of contact with the screening sleeve 70. Periodic maintenance of the machine 10 in being practiced can provide for removal of the screening sleeve 70 (as hereinafter described) for access to the shell access opening 50 through gate 192, so as to remove the tramp metal and the like from within the shell 110. For this purpose screw 160 is removed to open gate 192, and then reapplied to gate 192 and fastener plate 164 to hold the gate 192 in the closed relation shown in FIG. 7.

SPECIFIC DESCRIPTION

The housing member 34 that defines the in-feed chamber 14 in the form shown comprises a casting having the general shape of a T-fitting that defines oppositely directed end portions 180 and 182 that are formed to define the respective mounting flanges 214 and 216 for assembly purposes. The flange 214 is suitably secured by bolt and nut assemblies 215 to the flange 218 of the bearing mounting body 220 that is apertured at 222 to receive the auger end 116 as well as suitable elastomeric seals indicated at 224. The body 220 has suitably secured thereto the bearing 24 that journals auger assembly end 22.

Also secured to the housing member 34 at its flange 214 is depending bracket structure 230 to which the motor 30 is mounted as well as suitable drive shield 232 which covers pulley 234 driven by motor 30, the pulley 236 is keyed to the auger 102, and the endless belt 238 (which may be of the V type) that is trained over the pulleys 234 and 236 in any conventional manner.

In the form shown, the auger 102 is threaded within the recess 222 where indicated at 240, with the threading 240 to have a hand such that when the auger assembly 20 is driven in its bulk materials feeding direction with respect to the screening chamber 16, bulk materials in the area of the threading 240 will be fed away from the recess 222, and thus away from seals 224.

The housing member 34 is affixed to plate 54 in the form shown by employing suitable bolt assemblies 242 connected to the flange 216.

The screening sleeve 70 is of conventional design, that illustrated being the sieve cylinder employed in the aforementioned ROTA-SIEVE centrifugal screening machine. The screening sleeve 70 is therefore only diagrammatically illustrated as comprising a plurality of elongate tension rods 250 mounting a central screen mounting sleeve 252 and a pair of end screen mounting sleeves 254 and 256. Screening element 74 has its ends 260 and 262 suitably clamped to the respective mounting sleeves 254 and 252 by suitable clamp devices 264. Similarly, the screening element 76 has its ends 266 and 267 suitably secured to the respective mounting sleeves 252 and 256 by similar clamp devices 264. The nuts 269 and 271 at the respective ends of the rods 250 are adjusted to place the rods 250 under tension and thus tension the respective screens 74 and 76.

At the mounting plate assembly 60, the mounting sleeve 256 has its rim portion 270 received in the bore 86 of the annular member 88 for centering of the screening sleeve 70 with respect to the auger assembly 20. The mounting sleeve 254 has its flange portion 280 proportioned to slidably receive the end 82 of the housing member 34 for seating of the screen sleeve over the outlet of the in-feed chamber 14.

The screening sleeve 70 may thus be readily removed through gate 96 by removing mounting plate assembly 60, which exposes the sleeve 256 end of the screening sleeve for ready grasping and removal, thereby exposing shell 110 and its gate 152, for removal of foreign materials therefrom via gate 192. Reapplication of the screening sleeve is simply effected by reversing its removal procedure.

The mounting plate assembly 60 is removably held in place by thumb screws 283 applied to plate 56.

FIGS. 2 and 8 illustrate an optional feature of the invention in accordance with which a bulk materials guide sleeve 290 is applied to the inlet 42 of the housing member 34. Sleeve 290 is flanged as at 292 to seat on the flange 39 of sleeve 38, and defines tubular portion 294 of quadrilateral cross-sectional configuration that has one side of same angled to direct the bulk materials toward the upcoming side of the rotating auger assembly 20.

The sleeve 290 is formed from a suitable elastomeric material such as a rubber or plastic polymer based substance for guiding the bulk materials entering the in-feed chamber 14 to the auger assembly 20; sleeve 290 also guides in a similar manner tramp metal and the like into proper receiving position within the convolutions of flighting 106 while at the same time having its lower portion 298 flexible as needed to accommodate the presence of elongated items of tramp metal and other pieces of foreign material.

It will therefore be seen that the invention provides a method of centrifugally screening bulk materials and a centrifugal screen apparatus that are arranged to not only provide for an improved distribution of the bulk material longitudinally of the screening sleeve for screening purposes, but also provides a foreign material trap of a special nature. The trap accommodates movement therethrough of tailings and light weight trash that move into the tailings chamber for discharge therefrom, while retaining within same the heavier density items such as tramp metal, stones, and the like, which during operation of the machine, remain fast to the side wall of the trap under the action of centrifugal force and thus make a contribution to a more uniform supply of the bulk materials being screened to the screening sleeve.

When the machine is shut off the foreign matter retained within the trap remains in same in spaced from the screening sleeve. When the machine is given normal servicing of the character that would call for removal of the screening sleeve, the foreign material within the trap can be readily removed by access through the housing access opening and the trap access opening.

The machine auger, in-feed chamber, and trap are shaped and contoured to facilitate and accommodate ready passage of tramp metal or the like through the in-feed chamber into the trap for retention there during operation of the machine. The machine of this invention thus not only protects the screening sleeve from breakage and even undue wear due to bulk material concentrations on same, but also keeps foreign material from entering the screening chamber to foul the material that has been screened.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. A centrifugal screening apparatus comprising:

a housing defining a tubular bulk materials in-feed chamber and a screening chamber in open side-by-side communication, with said screening chamber being at one end of said in-feed chamber and defining a gravity discharge outlet therefrom, an auger assembly received in said chambers, a screening sleeve mounted in said screening chamber through which said auger assembly extends, said screening sleeve comprising foraminous material through which the bulk materials are to be screened, said auger assembly comprising:

an auger extending through said in-feed chamber and being journaled at one end thereof at the other end of said in-feed chamber, said auger at its other end extending into said screening chamber, a combination metal trap and bulk material feed distributor disposed within said screening sleeve and comprising:

a cylindrical shell extending the effective length of said screening sleeve and having an internal diameter that exceeds that of said auger and an outer diameter whereby the outer surfacing of said shell is in closely spaced relation to but spaced from said screening sleeve, said shell defining lengthwise thereof uniformly spaced apertures thereabout separated by imperforate walling, said shell at one end thereof extending over said other end of said auger, first spider means disposed interiorly of said shell for making said shell one end fast to said auger other end in coaxial concentric relation thereto, a stub shaft disposed adjacent the other end of said shell, second spider means disposed interiorly of said shell for making said shell other end fast to said stub shaft in coaxial concentric relation thereto, said housing further defining in alignment with said screening sleeve a tailings receiving chamber, third spider means for journaling said stub shaft in coaxial alignment with said auger and disposed exteriorly of said shell other end, said shell other end being open to said tailings chamber, means for making said screening chamber closed to said tailings receiving chamber exteriorly of said screening sleeve, said first spider means being open for unrestricted movement therethrough of the bulk materials from the auger into said shell, said second and third spider means being open for unrestricted movement therethrough of tailings from said shell into said tailings chamber, means for rotating said auger assembly at a speed that is at least 200 rpm, said shell apertures being proportioned in size for effecting bulk material passage radially of said shell under the centrifugal force generated by said auger assembly along substantially the length of said shell for spreading the bulk material applied in screening relation to said screening sleeve substantially along the length thereof, and means for feeding the tailings that are externally of said shell longitudinally thereof into said tailings chamber, whereby tramp metal in said bulk material larger than said apertures on entering said shell becomes adhered to the inside of said shell under centrifugal force during operation of said screening apparatus and is thereby held from penetrating said screening sleeve.

2. The apparatus set forth in claim 1 wherein:

said shell walling has an access opening in same and includes means for opening and closing said access opening, said housing including in the area of said screening chamber an access opening located in alignment with said shell access opening axially of said auger assembly, and means for shifting said screening sleeve longitudinally of said auger assembly for having access to said shell access opening through said housing access opening for manual removal of the tramp metal from said shell when said apparatus is not operating.

3. The apparatus set forth in claim 1 wherein:

said in-feed chamber below the level of the axis of said auger has its surfacing substantially complementing the external diameter of said auger for the length of said in-feed chamber, with the in-feed chamber surfacing portion that overlies said auger being spaced therefrom a distance approximating one seventh of the external diameter of said auger for accommodating conveyance of tramp metal by said auger through said in-feed chamber.

4. The apparatus set forth in claim 3 wherein:

the in-feed chamber surfacing portions on either side of said auger are formed to be in funneling relation to said in-feed surfacing that is below the level of said auger axis.

5. The apparatus set forth in claim 4 wherein:

the portion of said auger other end that is within said shell is of reduced external diameter.

6. The apparatus set forth in claim 1 wherein:

said shell apertures have a width lying in the range of from about one eighth inch to about three fourths inch.

7. The apparatus set forth in claim 1 wherein:

said rotating means rotates said auger assembly at a speed that lies in the range of from 200 rpm to about 1,200 rpm.

8. The apparatus set forth in claim 1 wherein:

said tailings feeding means comprises one or more wiper bars affixed to said outer surfacing of said shell and extending longitudinally thereof.

* * * * *